US005928824A

United States Patent [19]

Obinata et al.

[11] Patent Number: 5,928,824

[45] Date of Patent: Jul. 27, 1999

[54] ELECTROPHOTOGRAPHIC PHOTOCONDUCTOR

[75] Inventors: Takashi Obinata; Sumitaka Nogami, both of Nagano, Japan

[73] Assignee: Fuji Electric Co., Ltd., Japan

[21] Appl. No.: 08/902,583

[22] Filed: Jul. 29, 1997

[30] Foreign Application Priority Data

Aug. 13, 1996 [JP] Japan ..... 8-213352

[51] Int. Cl.[6] ..... G03G 5/14

[52] U.S. Cl. ..... 430/62; 430/131

[58] Field of Search ..... 430/58, 59, 62, 430/63, 64, 65, 131

[56] References Cited

U.S. PATENT DOCUMENTS

| | | | |
|---|---|---|---|
| 4,343,881 | 8/1982 | Sher et al. | 430/60 |
| 5,478,685 | 12/1995 | Nogami et al. | 430/62 |
| 5,641,599 | 6/1997 | Markovics et al. | 430/64 |

*Primary Examiner*—John Goodrow
*Attorney, Agent, or Firm*—Morrison Law Firm

[57] ABSTRACT

An electrophotographic photoconductor includes a conductive substrate, an intermediate layer on the conductive substrate, and a photoconductive layer on the intermediate layer. The intermediate layer includes an n-type semiconductive organic pigment.

15 Claims, 2 Drawing Sheets

(II)

(II)

ELECTROPHOTOGRAPHIC PHOTOCONDUCTOR

BACKGROUND OF THE INVENTION

The present invention relates to an intermediate layer of an electrophotographic photoconductor. More specifically, the present invention relates to organic pigments used for the intermediate layer.

Electrophotographic photoconductors (hereinafter simply referred to as "photoconductors") having a photoconductive layer on an electrically conductive substrate (hereinafter simply referred to as a "substrate") are well known. To achieve a desirable level of image quality, the photoconductors must maintain a stable charge potential, a stable residual potential and high sensitivity during repeated use. An intermediate layer is often disposed between the photoconductive layer and the substrate to produce a photoconductor having excellent charging properties. This intermediate layer prevents reduction of the charging potential, which is caused when charges having an polarity opposite to that of the charge potential are injected from the substrate into the photoconductive layer.

The resins used for the intermediate layer include resins of the cellulose family (Japanese Unexamined Laid Open Patent Application No. H02-238459); members of the poly (ether urethane) family (Japanese Unexamined Laid Open Patent Applications Nos. H02-115858 and H02-280170); melamine family (Japanese Unexamined Laid Open Patent Application No. H04-229666, and Japanese Examined Patent Applications Nos. H04-31576 and H04-31577); phenol family (Japanese Unexamined Laid Open Patent Application No. H03-48256); and polyamide family (Japanese Unexamined Laid Open Patent Applications Nos. H02-193152, H03-288157 and H04-31870).

However, charge potential reduction and residual potential rise may still occur in photoconductors having a conventional intermediate layer containing one of the above described resins. Charge potential reduction and residual potential rise in turn lead to image density reduction and greasing. Furthermore, the electrical resistance of a conventional intermediate layer increases when a photoconductor having such an intermediate layer is used repeatedly in a low temperature and low humidity environment, or when the intermediate layer is thickened to cover spots and defects in the substrate. This increase in electrical resistance of the intermediate layer leads to further residual potential rise and reduction in sensitivity.

To obtain a photoconductor having high sensitivity and low residual potential without the problems described above, the electrical resistance of the intermediate layer is often adjusted. Previously proposed means to adjust the electrical resistance of conventional intermediate layers include addition of a metal powder, such as Al powder or Ni powder, to a conductive pigment, such as indium oxide, tin oxide or carbon (Japanese Examined Patent Applications Nos. H01-51185, H02-48175 and H02-60177); addition of organometallic compounds (Japanese Examined Patent Application No. H03-4904 and the Japanese Unexamined Laid Open Patent Application No. H02-59767); and addition of a conductive organic polymer, such as polypyrrole or polyaniline (Japanese Unexamined Laid Open Patent Application No. H05-61234). However, in the case of the metal powders, it is difficult to uniformly disperse the mixtures of the metal powders with the conductive organic pigments. Uneven dispersion and aggregation of the conductive organic pigments can create a defective coating film. As for the organometallic compounds and the conductive polymers, these are not yet widely used, since there remain problems with the solubility of these organic components and stability of the coating liquids containing these organic components.

OBJECTS AND SUMMARY OF THE INVENTION

In view of the foregoing, it is an object of the invention to overcome the limitations of the prior art, including those described above.

It is another object of the present invention to provide an electrophotographic photoconductor having an intermediate layer that contains an improved organic pigment.

It is another object of the invention to provide an electrophotographic photoconductor that does not cause charge potential reduction, residual potential rise, printing density reduction, greasing or defective printing after repeated use.

Briefly stated, an electrophotographic photoconductor includes a conductive substrate, an intermediate layer on the conductive substrate, and a photoconductive layer on the intermediate layer. The intermediate layer includes an n-type semiconductive organic pigment.

According to one embodiment of the present invention, there is provided an electrophotographic photoconductor, the electrophotographic photoconductor comprising a conductive substrate, an intermediate layer on the conductive substrate, the intermediate layer comprising an organic pigment, the organic pigment exhibiting n-type semiconductive properties, and a photoconductive layer on the intermediate layer.

According to another embodiment of the present invention, there is provided an intermediate layer of a electrophotographic photoconductor, comprising an organic pigment, the organic pigment exhibiting n-type semiconductive properties.

According to another embodiment of the present invention, there is provided a method of producing an intermediate layer of an electrophotographic photoconductor, comprising the steps of forming an intermediate layer on a conductive substrate, the intermediate layer comprising an organic pigment, the organic pigment exhibiting n-type semiconductive properties, and forming a photoconductive layer on the intermediate layer.

Advantageously, the organic pigment may be dichloro (phthalocyaninato)tin or chloro(phthalocyaninato)zinc. Advantageously, the organic pigment may also be a perylene pigment described by general chemical formula (I) in FIG. 4 or its derivative. Advantageously, the organic pigment may also be a bisazo pigment described in FIG. 5 by general chemical formula (II), where X is a halogen atom or a methoxy group, and R a halogen atom, a methoxy group or a nitro group.

The electrical conduction of a conventional intermediate resin layer is affected by changes in the ionic conduction due to the hygroscopicity of the constituent resin of the intermediate layer. Accordingly, the conductivity of a conventional intermediate resin layer is reduced and the sensitivity varies in a low temperature and low humidity environment. However, the intermediate layer of the present invention is not affected by changes in the temperature or humidity of the environment, due to the n-type semiconductivity of the organic pigment used in the intermediate layer of the present invention. Therefore, in the intermediate layer of the present invention, electrons generated in the photoconductive layer during the electrophotographic process move easily into the substrate and prevent variations in potential, such as residual potential rise.

The present invention is applicable to a photoconductor that includes a conductive substrate, an intermediate layer on the substrate and a single layered photoconductive layer on the intermediate layer, as shown in FIG. 3. The present invention is applicable also to a function separation-type photoconductor that includes a conductive substrate, an intermediate layer on the substrate and a laminated photoconductive layer consisting of a charge generation layer and a charge transport layer, as shown in FIGS. 1 and 2.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
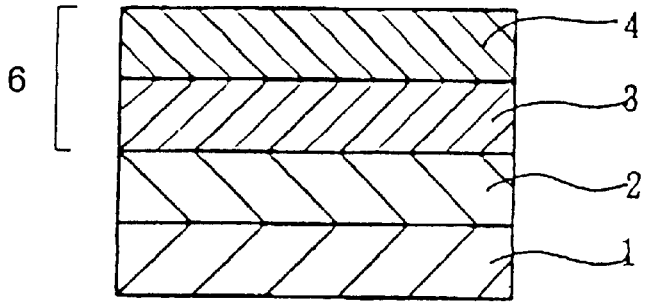
FIG. 1 is a cross-sectional view of a negative-charging function-separation-type photoconductor having an intermediate layer of the present invention.
Figure 2:
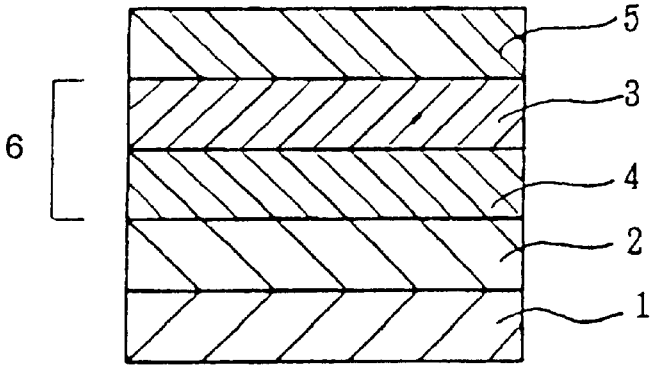
FIG. 2 is a cross-sectional view of a positive-charging function-separation-type photoconductor having an intermediate layer of the present invention.
Figure 3:
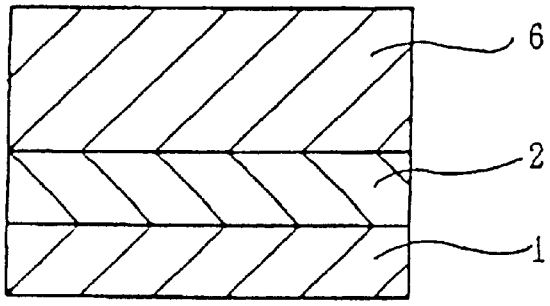
FIG. 3 is a cross-sectional view of a positive-charging photoconductor having a single-layered photoconductive layer and an intermediate layer of the present invention.

FIGS. 1, 2, and 3 show several types of photoconductors and the location of the intermediate layer of the present invention in each. Intermediate layer 2 is between conductive substrate 1 and photoconductive layer 6 in each type of photoconductor. In the negative-charging function-separation-type photoconductor (FIG. 1), intermediate layer 2 is between conductive substrate 1 and charge generation layer 3, which forms the inner portion of photoconductive layer 6. In the positive-charging function-separation-type photoconductor (FIG. 2), intermediate layer 2 is between conductive substrate 1 and charge transport layer 4, which forms the inner portion of photoconductive layer 6. FIG. 3 shows a positive-charging photoconductor having a single-layered photoconductive layer 6 and intermediate layer 2 of the present invention between conductive substrate 1 and photoconductive layer 6. The photoconductors of FIGS. 1, 2, and 3 may also include a surface protection layer 5, as shown in FIG. 2.

Metals such as Al and Ni, alloys such as stainless steel, inorganic and organic insulators such as glass, ceramics, paper and plastics covered with a conductive material such as Al, Ni, carbon and $SnO_2$ or into which one of these conductive materials is dispersed may be used for conductive substrate 1. Conductive substrate 1 preferably exhibits electrical resistance of $10^8$ Ω cm or less. Conductive substrate 1 also preferably is resistant to solvents and heat, and particularly preferably resists the conditions used to form charge generation layer 3 and charge transport layer 4.

Figure 4:
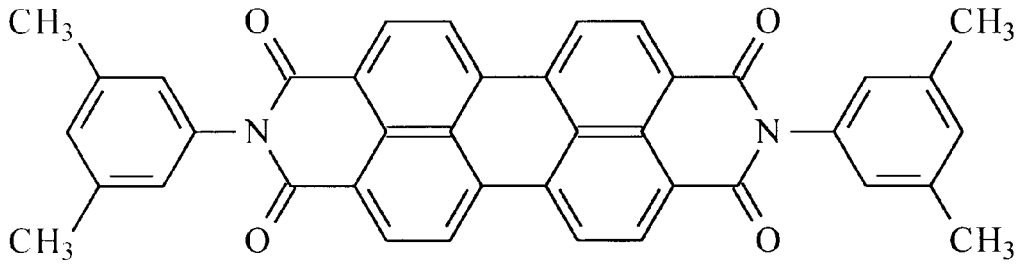
FIG. 4 is a chemical formula of the perylene pigment used in an intermediate layer of the present invention.
Figure 5:
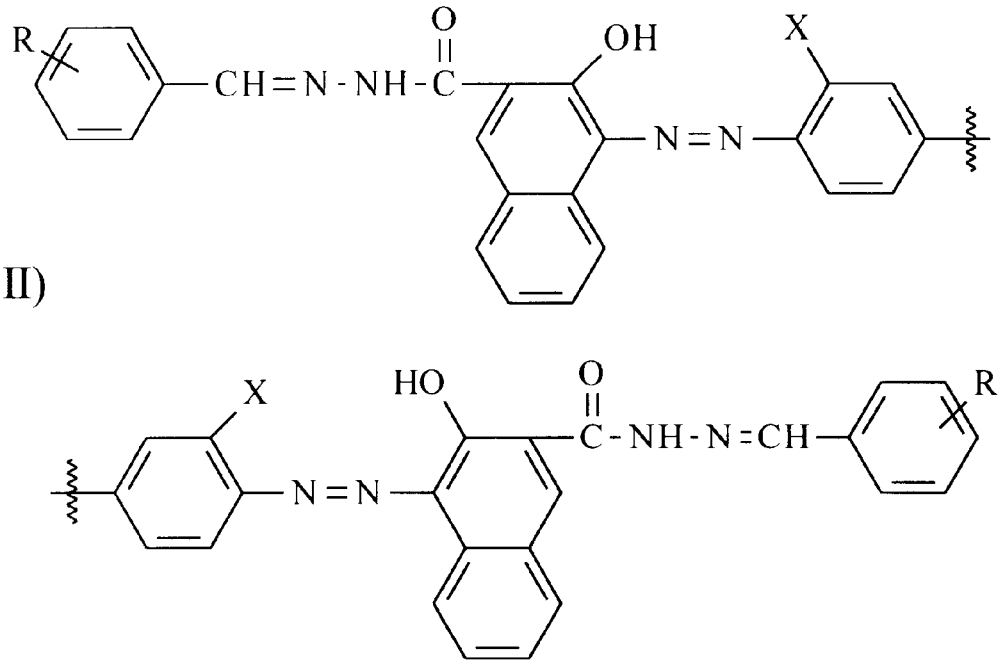
FIG. 5 is a general formula of the bisazo pigment used in an intermediate layer of the present invention.

The organic pigments used for intermediate layers of the present invention exhibit n-type semiconductive properties and include dichloro(phthalocyaninato)tin, chloro(phthalocyaninato)zinc, a perylene pigment as described by general chemical formula (I) in FIG. 4 or its derivatives, and/or a bisazo pigment as described in FIG. 5 by general chemical formula (II). In general chemical formula (II), X is a halogen atom or a methoxy group, and R a halogen atom, a methoxy group or a nitro group.

The intermediate layer of the present invention is formed on a conductive substrate by coating and drying a coating liquid onto the substrate. The coating liquid is one in which one of the above described organic pigments and a resin binder are mixed. The binder resin may include a thermoplastic resin such as polyester, polycarbonate, polyamide, polystyrene, polyacrylate and poly(vinyl alcohol), a thermosetting resin such as phenolic resin, epoxy resin and melamine resin, and/or some photo-hardening resins. When it is required for the intermediate layer to be chemically resistive, the above described resins may be thermally treated at between 100° and 200° C. with a cross-linking agent. The coating liquid for the intermediate layer may be coated onto the conductive substrate by any well known method, including the dipping method, doctor blade method, spray method and roll copying method. The coating liquid for the intermediate layer preferably is coated onto the conductive substrate by dip-coating.

Preferably, from 0.5 to 200 weight parts of the organic pigment and 100 weight parts of the binder resin are mixed. When the mixing ratio of the pigment to the binder resin is less than 0.5, the sensitivity declines greatly after repeated use. When the mixing ratio of the pigment to the binder resin exceeds 200, the dispersibility of the organic pigment is dramatically reduced. As a result, the charging characteristics of the photoconductor declines with reduced dispersion of the organic pigment. A thick intermediate layer of the present invention does not adversely affect the electrical properties of the photoconductor, because the intermediate layer contains the organic pigment. However, the intermediate layer is preferably 20 μm or less in thickness. This avoids orange peel-like defects caused during film formation, which may occur depending on the viscosity of the coating liquid.

When a photoconductor having the intermediate layer of the present invention is used in a laser beam printer, an inorganic pigment, such as titanium oxide, zinc oxide, silicon oxide or alumina, is preferably contained in the intermediate layer. The inorganic pigment reduces interference between the photoconductive layer and the laser beam. The level of interference encountered is a function of the refractive index and film thickness of the photoconductive layer, and the wavelength of the laser beam.

The charge generating agent used in the charge generation layer preferably includes an organic pigment such as an azo pigment, phthalocyanine pigment, bisazo pigment, indigo pigment or perylene pigment, or an inorganic pigment such as selenium powder, amorphous silicon powder or zinc oxide powder. The coating liquid for the charge generation layer is prepared by dispersing the above described charge generating agent into a solution of binder resin such as polyester, polycarbonate and poly(vinyl butyral). The charge generation layer is formed by coating and drying the thus prepared coating liquid on the intermediate layer. The preferable thickness of the charge generation layer is from 0.1 to 2 μm.

The coating liquid for the charge transport layer is prepared by dispersing a charge transport agent and a binder resin into an appropriate solvent. The charge transport agent may be a hydrazone compound, a styryl compound and/or an amine compound. The binder resin may be any resin in which the charge transport agent is soluble, such as polyester, polycarbonate, polystyrene and/or styrene acrylate. The charge transport layer is formed on the charge generation layer by coating the thus prepared coating liquid onto the charge generation layer, followed by drying the coating liquid. The charge transport layer is formed preferably to be from 5 to 40 μm in thickness.

First embodiment

Ten weight parts of alcohol-soluble copolymerized polyamide resin (CM8000, from TORAY INDUSTRIES, INC.) was dissolved into a mixed solvent of 45 weight parts of methanol and 45 weight parts of methylene chloride. Sixty weight parts of dichloro(phthalocyaninato)tin was dispersed into the above described solution for 24 hr in a ball mill. An intermediate layer was formed to be 5 μm in thickness on an aluminum cylindrical substrate of 30 mm in outer diameter by dip-coating the thus prepared coating liquid and thereafter drying the coating liquid at 90° C. for 30 min.

The coating liquid for the charge generation layer was prepared by dissolving 1 weight part of poly(vinyl butyral) resin (S.LEC BL-S, from Sekisui Chemical Co., Ltd.) into 98 weight parts of tetrahydrofuran and by dispersing 1 weight part of X-type metal-free phthalocyanine into the poly(vinyl butyral) solution for 48 hr in a ball mill. A charge generation layer of 0.2 μm in thickness was formed on the intermediate layer by dip coating, followed by drying the coating liquid at 100° C. for 10 min.

The coating liquid for the charge transport layer was prepared by uniformly dissolving 10 weight parts of hydrazone compound (CTC191, from Anan Perfume Co., Ltd.) and 10 weight parts of polycarbonate resin (L-1225, from TEIJIN CHEMICALS LTD.) into 80 weight parts of methylene chloride. The coating liquid was coated on the charge generation layer by dip-coating and dried at 100° C. for 30 min to form a charge transport layer of 20 μm in thickness.

Second embodiment

The photoconductor of the second embodiment was fabricated in a similar manner as the first embodiment, except that a perylene pigment described by the general formula (I) in FIG. 4 was used in the second embodiment in place of dichloro(phthalocyaninato)tin of the first embodiment.

Third embodiment

The photoconductor of the third embodiment was fabricated in a similar manner as the first embodiment, except that a bisazo pigment described by general chemical formula (II) in FIG. 5, where X=Cl and R=Cl, was used in the third embodiment in place of dichloro(phthalocyaninato)tin of the first embodiment.

Fourth embodiment

In the fourth embodiment, 10 weight parts of a solution of acrylic thermosetting resin (Magicron No. 1000, from KANSAI PAINT CO., LTD.), was used in place of the alcohol-soluble copolymerized polyamide resin. The solution of acrylic thermosetting resin, as supplied, was adjusted with 50 weight parts of tetrahydrofuran so that the concentration of the solid components was 10 weight parts. Then, the coating liquid for the intermediate layer was prepared by dispersing 100 weight parts of dichloro(phthalocyaninato) tin into the adjusted solution for 24 hr in a ball mill.

The thus prepared coating liquid was coated on an aluminum cylindrical substrate of 30 mm in outer diameter by dip-coating. The intermediate layer then was dried at 140° C. for 40 min to form an intermediate layer of 5 μm in thickness.

A charge generation layer and a charge transport layer were then formed on the intermediate layer in a similar manner as in the first embodiment.

COMPARATIVE EXAMPLE 1

The photoconductor of comparative example 1 was fabricated in a similar manner as the photoconductor of the first embodiment, except that dichloro(phthalocyaninato)tin was not included in the intermediate layer of comparative example 1.

COMPARATIVE EXAMPLE 2

The photoconductor of comparative example 2 was fabricated in a similar manner as the photoconductor of the fourth embodiment, except that dichloro(phthalocyaninato) tin was not included in the intermediate layer of comparative example 2.

COMPARATIVE EXAMPLE 3

The photoconductor of comparative example 3 was fabricated in a similar manner as the photoconductor of the first embodiment, except that polyaniline was used in place of dichloro(phthalocyaninato)tin of the first embodiment.

The photoconductors fabricated as described above were mounted on a laser beam printer and subjected to a printing test under normal temperature and normal humidity conditions (temperature: 25° C., relative humidity: 50%) and under low temperature and low humidity conditions (temperature: 10° C., relative humidity: 20%). A continuous printing test on 50,000 sheets of paper was also conducted in each environment.

The test results in the normal temperature and normal humidity environment are listed in Table 1. The test results in the low temperature and low humidity environment are listed in Table 2. The printing density was measured with a Macbeth densitometer.

Table 1

| Normal Environment | | | | |
|---|---|---|---|---|
| | Initial Image | | After continuous printing | |
| | Density | Greasing | Density | Greasing |
| 1st embodiment | 1.41 | None | 1.40 | None |
| 2nd embodiment | 1.42 | None | 1.42 | None |
| 3rd embodiment | 1.41 | None | 1.41 | None |
| 4th embodiment | 1.41 | None | 1.42 | None |
| Comparative 1 | 1.39 | None | 1.33 | Black spots |
| Comparative 2 | Printing impossible | | Printing impossible | |
| Comparative 3 | 1.25 | Fogging | 1.23 | Fogging |

Table 2

| Low Temperature, Low Humidity | | | | |
|---|---|---|---|---|
| | Initial Image | | After continuous printing | |
| | Density | Greasing | Density | Greasing |
| 1st embodiment | 1.40 | None | 1.41 | None |
| 2nd embodiment | 1.41 | None | 1.41 | None |
| 3rd embodiment | 1.43 | None | 1.41 | None |
| 4th embodiment | 1.40 | None | 1.40 | None |
| Comparative 1 | 1.28 | None | 1.17 | Fogging |
| Comparative 2 | Printing impossible | | Printing impossible | |
| Comparative 3 | 1.15 | Fogging | 1.10 | Fogging |

As indicated clearly in Tables 1 and 2, the photoconductors of the first through fourth embodiments exhibit excellent printing quality in both environments tested. No printing density reduction or greasing was caused by these photoconductors. Furthermore, the characteristics of the photoconductors of the first through fourth embodiments were retained, despite repeated use. The photoconductors of the first through fourth embodiments exhibit more stable printing quality than the photoconductors of the prior art comparative examples.

The photoconductor of the present invention, which includes an intermediate layer containing an n-type semiconductive organic pigment, does not produce any residual potential rise, deterioration in charging characteristics, or defective printing qualities, such as printing density reduction or greasing.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor, comprising:

a conductive substrate;

an intermediate layer on said conductive substrate, said intermediate layer including an organometallic pigment, said organometallic pigment exhibiting n-type semiconductive properties; and a photoconductive layer on said intermediate layer.

2. The electrophotographic photoconductor according to claim 1, wherein said organometallic pigment includes dichloro(phthalocyaninato)tin.

3. The electrophotographic photoconductor according to claim 1, wherein said organometallic pigment includes chloro(phthalocyaninato)zinc.

4. An electrophotographic photoconductor comprising:

a conductive substrate, an intermediate layer on said conductive substrate, said intermediate layer including an organic pigment, said organic pigment exhibiting n-type semiconductive properties; and a photoconductive layer on said intermediate layer;

wherein said organic pigment includes a perylene pigment described by the following chemical formula (I):

(I)

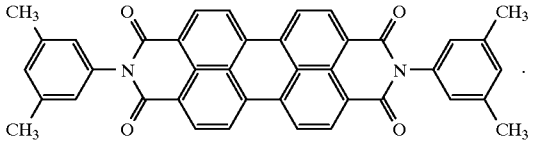

5. The electrophotographic photoconductor according to claim 1, further comprising a binder resin into which said organometallic pigment is mixed, such that said pigment is present at between 0.5 and 200 weight parts per 100 weight parts of binder resin.

6. An intermediate layer of an electrophotographic photoconductor, comprising an organometallic pigment, said organometallic pigment exhibiting n-type semiconductive properties.

7. An intermediate layer of a electrophotographic photoconductor according to claim 6, wherein said organometallic pigment includes dichloro(phthalocyaninato)tin.

8. An intermediate layer of an electrophotographic photoconductor according to claim 6, wherein said organometallic pigment includes chloro(phthalocyaninato)zinc.

9. An intermediate layer of an electrophotographic photoconductor comprising a perylene pigment described by the following chemical formula (I):

(I)

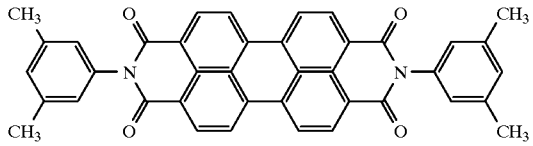

10. An intermediate layer of an electrophotographic photoconductor according to claim 6, further comprising a binder resin into which said organometallic pigment is mixed, such that said pigment is present at between 0.5 and 200 weight parts per 100 weight parts of binder resin.

11. A method of producing an intermediate layer of an electrophotographic photoconductor, comprising the steps of:

forming an intermediate layer on a conductive substrate, said intermediate layer including an organometallic pigment, said organometallic pigment exhibiting n-type semiconductive properties; and forming a photoconductive layer on said intermediate layer.

12. A method of producing an intermediate layer of an electrophotographic photoconductor according to claim 11, wherein said organometallic pigment includes dichloro (phthalocyaninato)tin.

13. A method of producing an intermediate layer of an electrophotographic photoconductor according to claim 11, wherein said organometallic pigment includes chloro (phthalocyaninato)zinc.

14. A method of producing an intermediate layer of an electrophotographic photoconductor comprising the steps of:

forming an intermediate layer on a conductive substrate said intermediate layer including an organic pigment said organic pigment exhibiting n-type semiconductive properties; and forming a photoconductive layer on said intermediate layer;

wherein said organic pigment is a perylene pigment described by the following chemical formula (I):

(I)

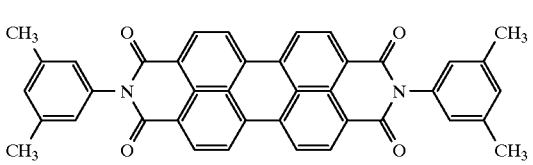

15. An intermediate layer of a electrophotographic photoconductor according to claim 11, further comprising a binder resin into which said organic pigment is mixed, such that said pigment is present at between 0.5 and 200 weight parts per 100 weight parts of binder resin.

* * * * *